United States Patent [19]

Meininger

[11] 4,178,904

[45] Dec. 18, 1979

[54] ARCHERY BOW

[76] Inventor: Karl Meininger, P.O. Box 391, Sheboygan, Wis. 53081

[21] Appl. No.: 743,329

[22] Filed: Nov. 19, 1976

[51] Int. Cl.[2] ..... F41B 5/00

[52] U.S. Cl. ..... 124/23 R; 124/41 A; 124/88

[58] Field of Search ..... 124/23 R, 24 R, 25 R, 124/41 A, 86, 90, 88, 16, 20 R, 20 B, 20 A

[56] References Cited

U.S. PATENT DOCUMENTS

| | | | |
|---|---|---|---|
| 320,643 | 6/1885 | Engle | 124/25 |
| 1,584,729 | 5/1926 | Cates | 124/16 |
| 2,507,271 | 5/1950 | Ringel | 124/24 R |
| 2,957,470 | 10/1960 | Barna | 124/24 R |
| 3,108,583 | 10/1963 | Andis | 124/20 R |
| 3,965,883 | 6/1976 | Meyer | 124/90 X |
| 4,018,205 | 4/1977 | Meyer | 124/23 R X |

*Primary Examiner*—Richard C. Pinkham
*Assistant Examiner*—William R. Browne
*Attorney, Agent, or Firm*—Andrus, Sceales, Starke & Sawall

[57] ABSTRACT

A bow frame is formed with a straight central portion and a pair of end limbs, with the latter extending either parallel to or toward the axis of draw. The bow string is about as long as the said central portion and is drawn toward the latter. The limbs are integral with the straight central portion, or may be pivotally mounted to the limb ends and biased outwardly by springs.

1 Claim, 7 Drawing Figures

ARCHERY BOW

PRIOR ART OF INTEREST

Cates U.S. Pat. No. 1,584,729—5-18-26 Barna U.S. Pat. No. 2,957,470—10-25-60

BACKGROUND AND SUMMARY OF THE INVENTION

This invention relates to an archery bow.

Heretofore, most archery bows have comprised a frame having limbs which extended outwardly away from the axis of draw, with the draw string connected between the outwardly extending limb tip portions. This type of construction has required that the draw string be drawn away from the bow frame in order to cause the limbs to flex.

It has been suggested as in the above identified U.S. Pat. No. 1,584,729 to form a bow of a single piece of tempered wire which is embedded in a base which acts as an arrow guide and a guard for the archer's hand. In that patent, the wire is drawn toward the base.

The present invention is based on an improvement over the above-mentioned devices. In accordance with one embodiment of the invention, the bow frame is integrally formed with a straight central portion and a pair of end limbs, with the latter not extending away from the axis of draw. The end limbs are thus either parallel to the axis of draw, or extend toward said axis. That is, the end limbs form an angle with inner face of the frame's central portion which is 90° or less. The draw string is straight, is attached adjacent the tips of the bow limbs, and is of about the same length as the frame's central portion.

In accordance with another embodiment of the invention, the limbs are pivotally mounted to the frame's central portion and are biased outwardly by springs to hold the draw string tight.

In both embodiments, the draw string is drawn toward the frame's central portion.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figure 1:
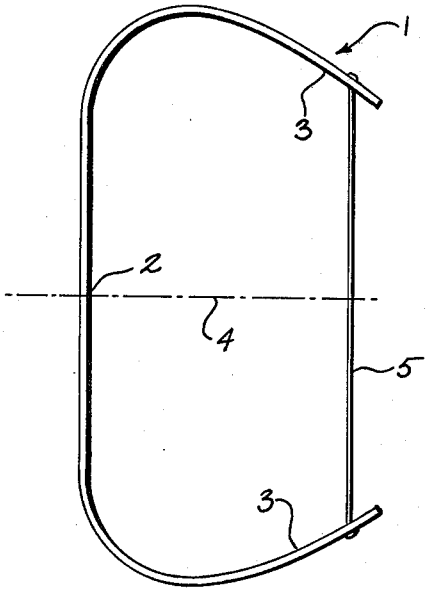
FIG. 1 is a side elevational view of a bow constructed in accordance with the invention, with the bow in normal position.

As shown in FIG. 1 of the drawings, the concept of the invention is embodied in an archery bow 1 having a frame comprising an elongated straight central portion 2 and a pair of end portions or limbs 3. In this embodiment, limbs 3 are integral with central portion 2 and curve inwardly toward the axis of draw 4 which is perpendicular to and passes through the center of portion 2. The ends of the limbs thus are normally disposed at less than 90° from portion 2 and face toward axis 4. A free straight draw string 5 is connected to the end portions of limbs 3 and is held in tension by the flexible limbs. Draw string 5 is co-extensive with straight central portion 2 and parallel thereto, and is substantially co-planar with the plane formed by the bow frame and limbs 3.

Figure 2:
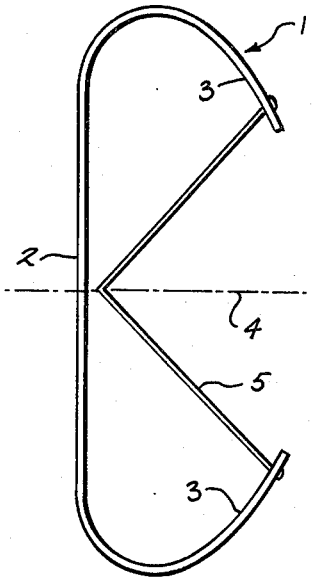
FIGS. 2 and 3 are side views illustrating the progressive positions of the bow frame and draw string during shooting.
Figure 3:
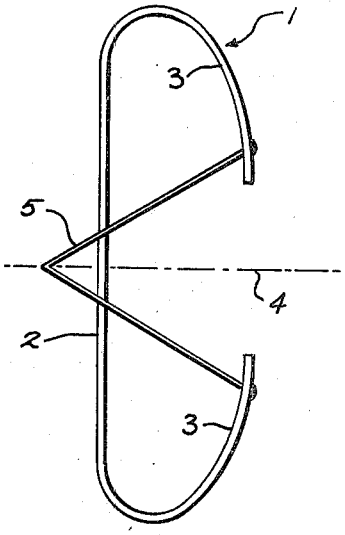
Figure 4:
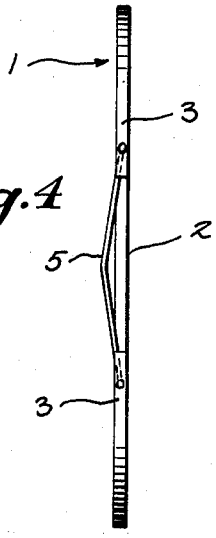
FIG. 4 is a front view of the bow of FIG. 3 with the string fully drawn.

As shown in FIGS. 2 and 3, when in use draw string 5 is pulled toward the bow frame and actually overlaps central portion 2 before it is released. Limbs 3 bow or flex inwardly toward central portion 2. A high velocity is thus imparted to the arrow. The construction is such that during an arrow projecting operation string 5 is drawn by one hand of the user toward central portion 2 while the other hand of the user holds portion 2 in front of the user's body.

Figure 5:
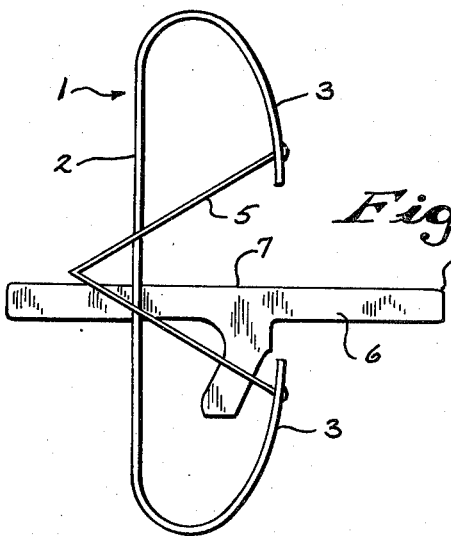
FIG. 5 is a view similar to FIG. 3 and showing the use of a hand grip.

If desired, a handle grip 6 may be attached to central portion 2, with grip 6 having an edge 7 closely adjacent and parallel to axis 4, as shown in FIG. 5. Edge 7 could at 8 support the arrow head end when aiming the arrow.

Figure 6:
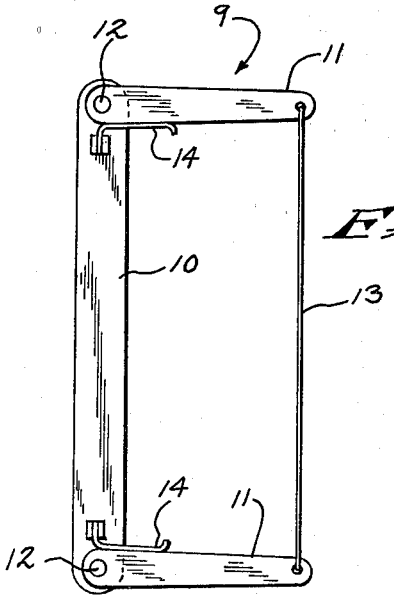
FIG. 6 is a side elevational view of a modified form of the invention.
Figure 7:
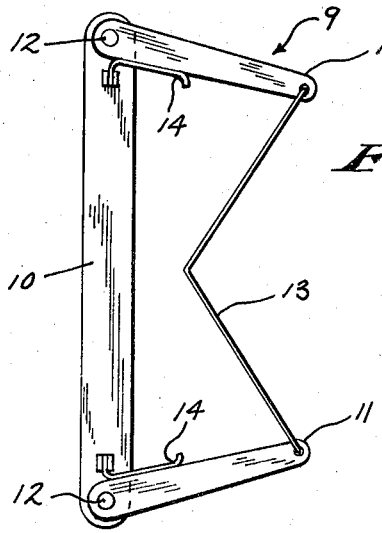
FIG. 7 is a view of the bow of FIG. 6 with the string partly drawn.

A second embodiment of the inventive concept is shown in FIGS. 6 and 7. In this instance, the bow 9 also includes a straight central portion 10 and a pair of straight end limbs 11. Here, however, limbs 11 are normally disposed at 90° to portion 10 and are separate elements pivotally mounted at their ends to the end portions of straight portion 10 as at 12. A straight draw string 13 is connected to the outer end portions of limbs 11 and is co-extensive with portion 10 and parallel thereto. Draw string 13 prevents limbs 11 from pivoting outwardly beyond 90°.

Limbs 11 are biased outwardly by means such as springs 14 on portion 10 to tension draw string 13. FIG. 7 shows the draw string partly drawn toward the bow frame with limbs 11 being forced inwardly against the force of springs 14.

The bow of the invention has been found to provide increased arrow velocity for the same weight of bow, as compared to prior devices.

Various modes of carrying out the invention are contemplated as being within the scope of the following claims particularly pointing out and distinctly claiming the subject matter which is regarded as the invention.

I claim:

1. An archery bow comprising, in combination:

(a) a frame comprising an elongated straight central portion having limbs extending from the ends thereof and with said frame defining an axis of draw for an arrow, (b) said limbs being integral with the frame and terminating in end portions which are normally disposed at an angle of less than 90° from the inner face of said central portion and with said end portions facing toward the axis of draw of the bow, (c) and a free straight draw string connected between the terminal end portions of said limbs, (d) said draw string being substantially coplanar with the plane formed by the frame and the limbs, said string being parallel to the said straight central portion of said frame and being the same length as said central portion, the construction being such that during an arrow projecting operation said string is drawn toward said straight central portion by one hand of a user while the other hand of the user holds the control portion in front of the user's body.

* * * * *

UNITED STATES PATENT AND TRADEMARK OFFICE

CERTIFICATE OF CORRECTION

PATENT NO. : 4,178,904

DATED : December 18, 1979

INVENTOR(S) : Karl Meininger

It is certified that error appears in the above-identified patent and that said Letters Patent are hereby corrected as shown below:

Column 2, Line 2, After "The" and before "ends" insert ----terminal----

Column 2, Line 4 After "the" and before "end" insert ----terminal----

Signed and Sealed this

*Eighteenth* Day of *March 1980*

[SEAL]

*Attest:*

SIDNEY A. DIAMOND

*Attesting Officer*

*Commissioner of Patents and Trademarks*